US011452381B2

(12) United States Patent
Cao

(10) Patent No.: US 11,452,381 B2
(45) Date of Patent: Sep. 27, 2022

(54) STORAGE TABLE/STOOL

(71) Applicant: Xin Cao, Guangdong (CN)

(72) Inventor: Xin Cao, Guangdong (CN)

( * ) Notice: Subject to any disclaimer, the term of this patent is extended or adjusted under 35 U.S.C. 154(b) by 729 days.

(21) Appl. No.: 16/423,033

(22) Filed: May 26, 2019

(65) Prior Publication Data

US 2020/0329876 A1 Oct. 22, 2020

(30) Foreign Application Priority Data

Apr. 20, 2019 (CN) ..... 201920541317.4

(51) Int. Cl.
*A47C 7/62* (2006.01)
*A47B 83/04* (2006.01)

(52) U.S. Cl.
CPC ..... *A47C 7/628* (2018.08); *A47B 83/045* (2013.01)

(58) Field of Classification Search
CPC ..... A47B 83/045; A47B 83/02; A47C 16/02
See application file for complete search history.

(56) References Cited

U.S. PATENT DOCUMENTS 2,509,395 A * 5/1950 Madan ..... A47C 3/16 229/5.5
2,919,169 A * 12/1959 Jackson ..... A47J 47/02 297/188.09
7,699,212 B2 * 4/2010 Turvey ..... B65D 21/0219 206/508
D771,963 S * 11/2016 Patel ..... D6/352
2011/0251535 A1 * 10/2011 Bender ..... A61M 21/02 601/49

* cited by examiner

*Primary Examiner* — Sarah B McPartlin

(57) ABSTRACT

A storage table/stool, having a bottom plate, a hollow cylinder body and a table plate or a seat cushion, the table plate or the seat cushion is placed at the top of the hollow cylinder body, and the bottom plate is arranged at the interior or the bottom of the hollow cylinder body; the hollow cylinder body has a screen frame body, an upper side frame at the top of the screen frame body, and a lower side frame at the bottom of the screen frame body, the upper side frame, the screen frame body and the lower side frame are formed separately or integrally, the upper side frame is bent inwards to form a first boss, the table plate or the seat cushion is detachably placed on the first boss, and the bottom plate is arranged at the interior or the bottom of the screen frame body.

9 Claims, 17 Drawing Sheets

STORAGE TABLE/STOOL

BACKGROUND OF THE INVENTION

The present disclosure relates to the technical field of storage tables/stools, and more specifically to a storage table/stool.

Household article collection and organization in daily life need a storage box for storage and collection, but the existing storage box can only be used for storing, so the practicability and the use value of the storage box are largely reduced. Moreover, the existing storage box cannot be stacked so as to occupy a large space during transportation, thereby increasing the transportation cost.

BRIEF SUMMARY OF THE INVENTION

An objective of the present disclosure is to provide a storage table/stool in order to overcome the above defects in the prior art, which has a simple structure, is convenient to assemble, effectively saves the transportation cost and reduces the occupied space.

In order to achieve the above objective, the present disclosure provides a storage table/stool, the storage table/stool comprises a bottom plate, a hollow cylinder body and a table plate or a seat cushion, the table plate or the seat cushion is placed at the top of the hollow cylinder body, the bottom plate is arranged at the interior or the bottom of the hollow cylinder body, the hollow cylinder body comprises an upper side frame, a screen frame body and a lower side frame, the upper side frame is arranged at the top of the screen frame body, the lower side frame is arranged at the bottom of the screen frame body, the upper side frame, the screen frame body and the lower side frame are formed separately or integrally, the upper side frame is bent inwards to form a first boss, the table plate or the seat cushion is detachably placed on the first boss, and the bottom plate is arranged at the interior or the bottom of the screen frame body.

Preferably, the storage table/stool further comprises first connectors, the first connectors match with and are fixedly connected with the lower side frame and the bottom plate; each first connector is provided with a first groove and a second groove, a locating bump is arranged on one side face of the first groove, a limiting groove is opened in the bottom of one side of the second groove, a locating hole is opened in the lower side frame, and matches with and is in clamping connection with the locating bump, the lower side frame matches with and is in inserting connection with the first groove, and the locating bump matches with and is in clamping connection with the locating hole, so that the lower side frame and the first connector are fixedly connected; and the circumferential edge of the bottom plate extends downwards to form a clamping ring, the bottom of the clamping ring extends outwards and is provided with a hook tilted upwards, the clamping ring matches with and is in inserting connection with the second groove, and the hook firstly matches with and is in clamping connection with the limiting groove so that the clamping ring is fixedly connected with the first connector, and then the bottom plate is fixedly connected with the first connector.

Preferably, a through hole is opened in the first connector in a horizontal direction, a thread is arranged in the through hole, a first connecting hole is opened in the bottom plate and matches with the through hole, and a second connecting hole is opened in the lower side frame and matches with the through hole.

Preferably, the storage table/stool further comprises second connectors and locking screws, wherein each second connector is arranged at the interior of the screen frame body; and the second connector is reverse L-shaped, a vertical side of the second connector is welded at the interior of the screen frame body, a third threaded hole is opened in a transverse side of the second connector, a fourth threaded hole is opened in the bottom plate and matches with the third threaded hole, and the locking screw matches with and locks the third threaded hole after passing through the fourth threaded hole, so that the bottom plate is fixedly arranged on the transverse side of the second connector.

Preferably, the storage table/stool further comprises fixing screws, wherein the lower side frame is bent inwards to form a second boss, a plurality of first threaded holes are opened in the second boss and can allow penetration of the fixing screws, a plurality of second threaded holes are opened in the circumferential edge of the bottom plate and match with the first threaded holes, and the fixing screws match with and lock the second threaded holes after passing through the corresponding first threaded holes so that the bottom plate is fixedly connected with the lower side frame.

Preferably, a plurality of grooves are opened in the circumferential edge of the first boss.

Preferably, the screen frame body is a metal screen frame body.

Preferably, the hollow cylinder body is a hollow column body with a section in shape of an ellipse, a square, a circle or a polygonal rhombus.

Compared with the prior art, the present disclosure has the beneficial effects:

1. the storage table/stool of the present disclosure has the simple structure and comprises the bottom plate, the hollow cylinder body and the table plate or the seat cushion, the table plate or the seat cushion is placed at the top of the hollow cylinder body, and the bottom plate is arranged at the interior or the bottom of the hollow cylinder body, wherein the hollow cylinder body comprises the upper side frame, the screen frame body and the lower side frame, the upper side frame is arranged at the top of the screen frame body, the lower side frame is arranged at the bottom of the screen frame body, the upper side frame, the screen frame body and the lower side frame are formed separately or integrally, the upper side frame is bent inwards to form the first boss, the table plate or the seat cushion is detachably placed on the first boss, and the bottom plate is arranged at the interior or the bottom of the screen frame body. The storage table/stool is convenient to assemble; different sizes of a plurality of storage tables/stools can be stacked during transportation so that the occupied space during transportation is reduced, the storage tables/stools are convenient to transport, and the transportation cost is saved; and the interior of the hollow cylinder body can contain articles so that the practicability of the storage table/stool is largely improved.

2. the storage table/stool of the present disclosure further comprises the first connectors, the first connectors match with and are fixedly connected with the lower side frame and the bottom plate; each first connector is provided with the first groove and the second groove, the locating bump is arranged on one side face of the first groove, the limiting groove is opened in the bottom of one side of the second groove, the locating hole is opened in the lower side frame, and matches with and is in clamping connection with the locating bump, the lower side frame matches with and is in inserting connection with the first groove, and the locating bump matches with and is in clamping connection with the locating hole, so that the lower side frame and the first connector are fixedly connected; the circumferential edge of the bottom plate extends downwards to form the clamping ring, the bottom of the clamping ring extends outwards and is provided with the hook tilted upwards, the clamping ring matches with and is in inserting connection with the second groove, and the hook firstly matches with and is in clamping connection with the limiting groove so that the clamping ring is fixedly connected with the first connector, and then the bottom plate is fixedly connected with the first connector; the lower side frame is clamped in the first groove, and the bottom plate is clamped in the second groove, so the bottom plate is fixedly connected with the lower side frame; and when the bottom plate is arranged at the bottom of the hollow cylinder body, the seat cushion is arranged on the first boss so that the seat cushion, the hollow cylinder body and the bottom plate form a storage stool.

3. the storage table/stool of the present disclosure further comprises the second connectors, wherein each second connector is arranged at the interior of the screen frame body; and the second connector is reverse L-shaped, the vertical side of the second connector is welded at the interior of the screen frame body, and the bottom plate is arranged on the transverse side of the second connector; and when the second connector is arranged at the interior of the hollow cylinder body, and the bottom plate is arranged at the interior of the hollow cylinder body, the table plate is arranged on the first boss so that the table plate, the hollow cylinder body and the bottom plate form a storage table.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show some embodiments of the present disclosure, and a person of ordinary skill in the art may still derive other drawings from these accompanying drawings without creative efforts.

DETAILED DESCRIPTION OF THE INVENTION

Figure 1:
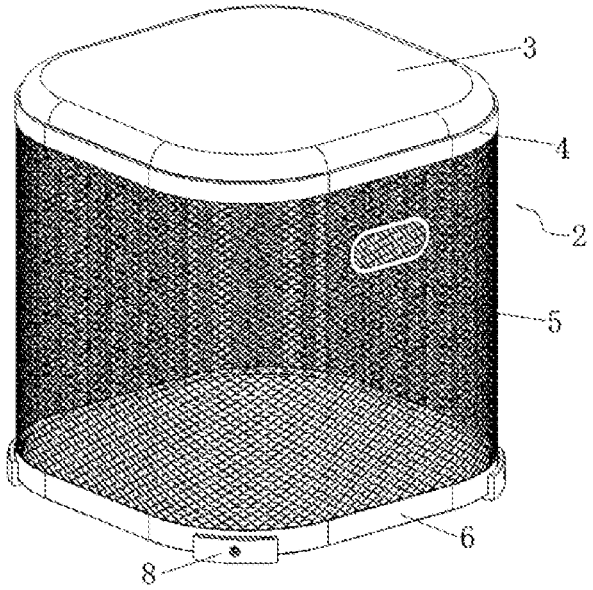
FIG. 1 is a schematic structural diagram of a storage table/stool provided by the present disclosure.

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. Apparently, the described embodiments are some rather than all of the embodiments of the present disclosure. All other embodiments obtained by a person of ordinary skill in the art based on the embodiments of the present disclosure without creative efforts shall fall within the protection scope of the present disclosure.

Embodiment 1

Referring to FIG. 1, FIG. 2, FIG. 4, FIG. 5 and FIG. 6, embodiment 1 of the present disclosure provides a storage table/stool, the storage table/stool comprises a bottom plate 1, a hollow cylinder body 2 and a table plate or a seat cushion 3, wherein the table plate or the seat cushion 3 is placed at the top of the hollow cylinder body 2, the bottom plate 1 is arranged at the bottom of the hollow cylinder body 2, the hollow cylinder body 2 comprises an upper side frame 4, a screen frame body 5 and a lower side frame 6, the upper side frame 4 is arranged at the top of the screen frame body 5, the lower side frame 6 is arranged at the bottom of the screen frame body 5, the upper side frame 4, the screen frame body 5 and the lower side frame 6 are formed separately, the upper side frame 4 is bent inwards to form a first boss 7, the table plate or the seat cushion 3 is detachably placed on the first boss 7, and the bottom plate 1 is arranged at the bottom of the screen frame body 5. The following describes the present embodiment in detail with reference to the accompanying drawings.

As shown in FIG. 4, FIG. 5, FIG. 6 and FIG. 14, the storage table/stool further comprises first connectors 8, the first connectors 8 match with and are fixedly connected with the lower side frame 6 and the bottom plate 1; each first connector 8 is provided with a first groove 9 and a second groove 10, a locating bump 11 is arranged on one side face of the first groove 9, a limiting groove 12 is opened in the bottom of one side of the second groove 10, a locating hole 14 is opened in the lower side frame 6, and matches with and is in clamping connection with the locating bump 11, the lower side frame 6 matches with and is in inserting connection with the first groove 9, and the locating bump 11 matches with and is in clamping connection with the locating hole 14, so that the lower side frame 6 and the first connector 8 are fixedly connected; the circumferential edge of the bottom plate 1 extends downwards to form a clamping ring 15, the bottom of the clamping ring 15 extends outwards and is provided with a hook 16 tilted upwards, the clamping ring 15 matches with and is in inserting connection with the second groove 10, and the hook 16 firstly matches with and is in clamping connection with the limiting groove 12 so that the clamping ring 15 is fixedly connected with the first connector 8, and then the bottom plate 1 is fixedly connected with the first connector 8; the lower side frame 6 is clamped in the first groove 9, and the bottom plate 1 is clamped in the second groove 10, so the bottom plate 1 is fixedly connected with the lower side frame 6; and when the bottom plate 1 is arranged at the bottom of the hollow cylinder body 2, the seat cushion 3 is arranged on the first boss 7 so that the seat cushion 3, the hollow cylinder body 2 and the bottom plate 1 form a storage stool.

Furthermore, the size of the hollow cylinder body 2 can be different, so that a relatively smaller hollow cylinder body 2 can be stacked in a relatively larger hollow cylinder body 2 from the bottom up; therefore, the occupied space during transportation is reduced, the storage table/stool is convenient to transport, and the transportation cost is saved; moreover, the interior of the hollow cylinder body 2 can contain articles so that the practicability of the storage table/stool is largely improved.

Wherein the upper side frame 4, the screen frame body 5 and the lower side frame 6 are formed separately; the upper side frame 4 sleeves the top of the screen frame body 5, and the upper side frame 4 and the screen frame body 5 are fixedly connected by pressing; and the lower side frame 6 sleeves the bottom of the screen frame body 5, and the lower side frame 6 and the screen frame body 5 are fixedly connected by pressing.

Embodiment 2

Figure 7:
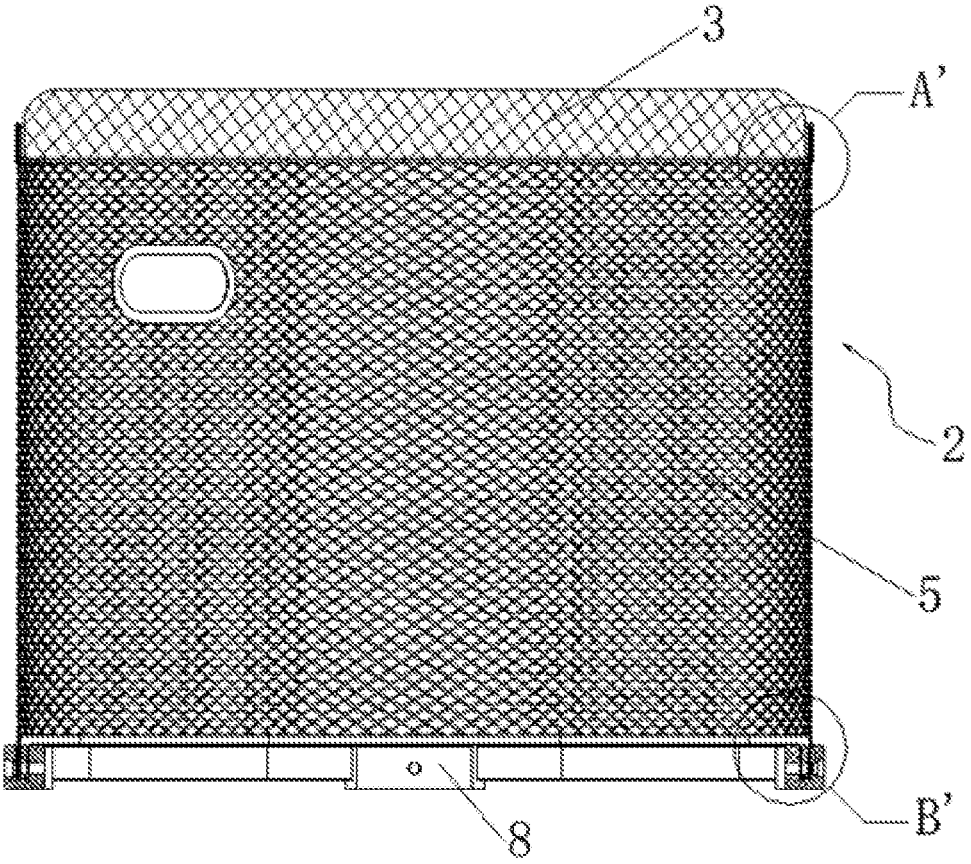
FIG. 7 is a schematic structural diagram of a storage table/stool provided by embodiment 2 of the present disclosure.
Figure 8:
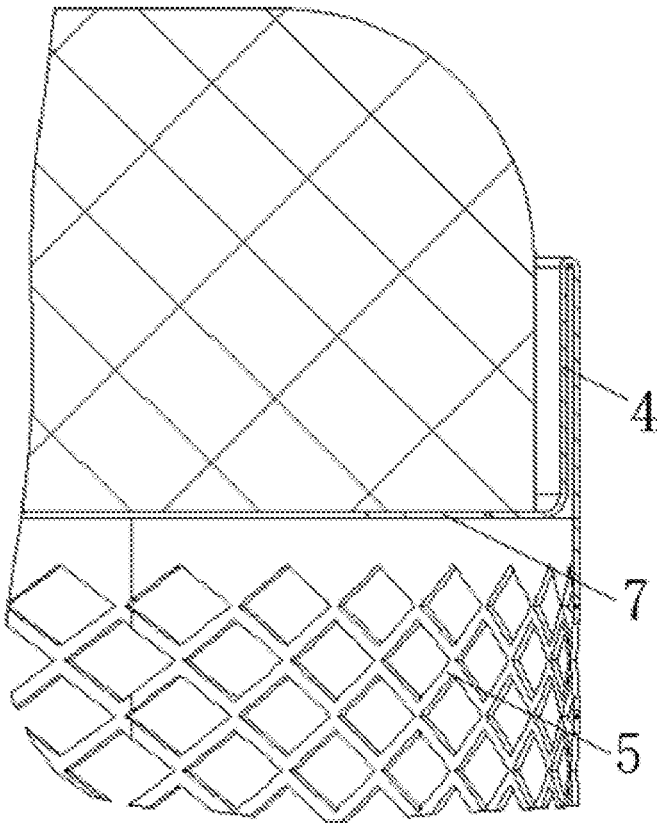
FIG. 8 is a schematic structural diagram of an A'-part and an A'" part in a storage table/stool provided by embodiment 2 and embodiment 4 of the present disclosure.
Figure 9:
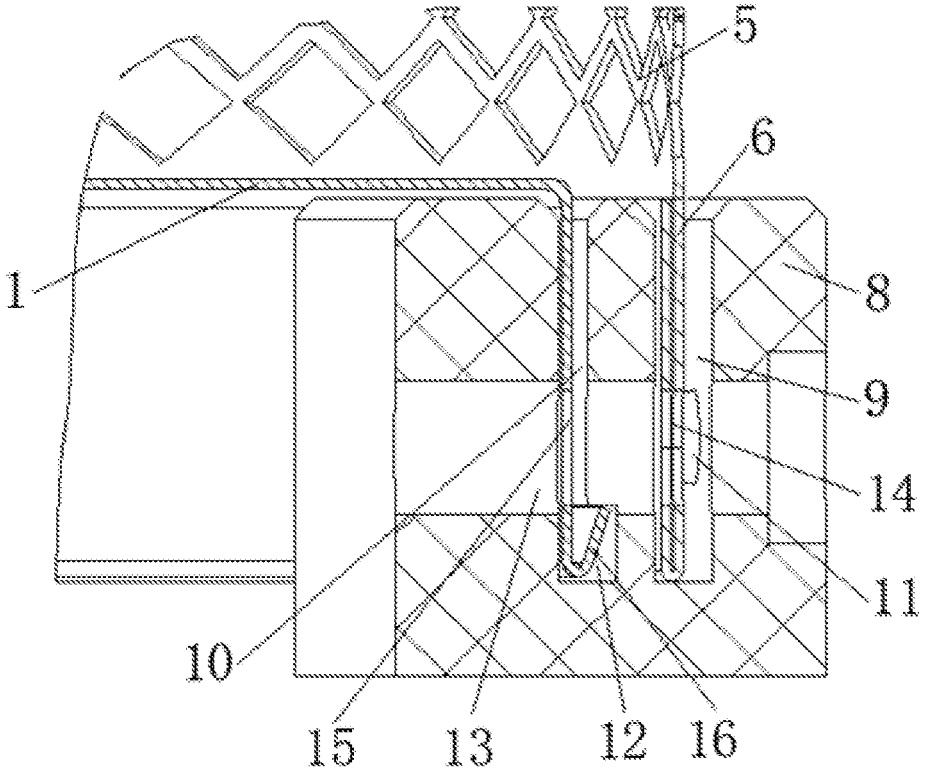
FIG. 9 is a schematic structural diagram of a B'-part in the storage table/stool provided by embodiment 2 of the present disclosure.

Referring to FIG. 7, FIG. 8 and FIG. 9, embodiment 2 of the present disclosure provides a storage table/stool, the storage table/stool comprises a bottom plate 1, a hollow cylinder body 2 and a table plate or a seat cushion 3, wherein the table plate or the seat cushion 3 is placed at the top of the hollow cylinder body 2, the bottom plate 1 is arranged at the bottom of the hollow cylinder body 2, the hollow cylinder body 2 comprises an upper side frame 4, a screen frame body 5 and a lower side frame 6, the upper side frame 4 is arranged at the top of the screen frame body 5, the lower side frame 6 is arranged at the bottom of the screen frame body 5, the upper side frame 4, the screen frame body 5 and the lower side frame 6 are formed integrally, the upper side frame 4 is bent inwards to form a first boss 7, the table plate or the seat cushion 3 is detachably placed on the first boss 7, and the bottom plate 1 is arranged at the bottom of the screen frame body 5. The following describes the present embodiment in detail with reference to the accompanying drawings.

Figure 14:
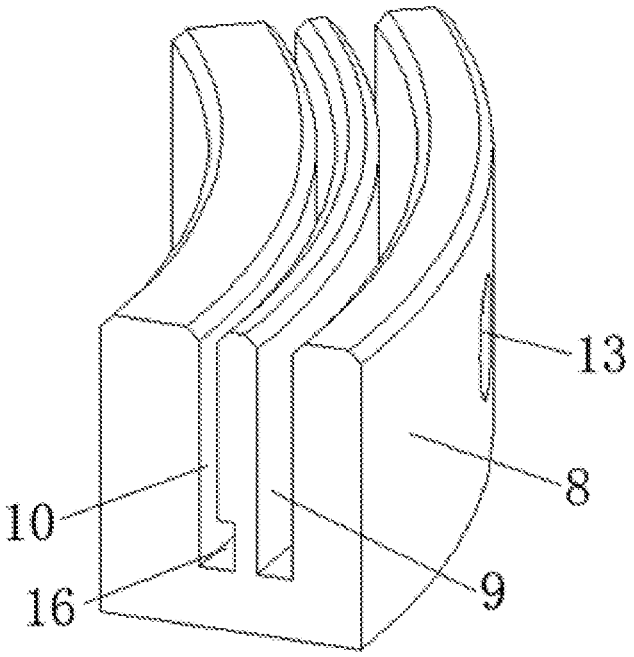
FIG. 14 is a schematic structural diagram of a first connector in the storage table/stool provided by the present disclosure.
Figure 15:
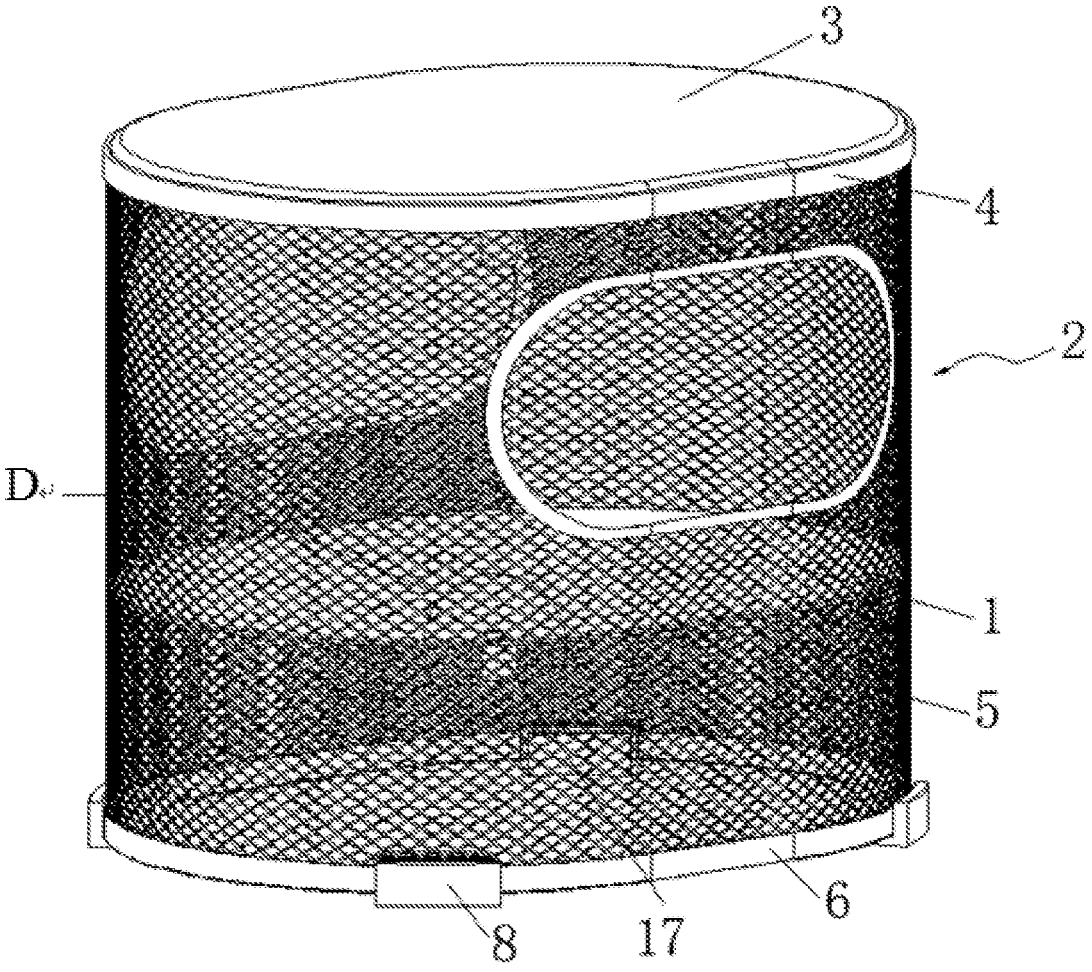
FIG. 15 is a schematic structural diagram of a storage table/stool provided by embodiment 5 of the present disclosure.

As shown in FIG. 8, FIG. 9 and FIG. 14, the storage table/stool further comprises first connectors 8, the first connectors 8 match with and are fixedly connected with the lower side frame 6 and the bottom plate 1; each first connector 8 is provided with a first groove 9 and a second groove 10, a locating bump 11 is arranged on one side face of the first groove 9, a limiting groove 12 is opened in the bottom of one side of the second groove 10, a locating hole 14 is opened in the lower side frame 6, and matches with and is in clamping connection with the locating bump 11, the lower side frame 6 matches with and is in inserting connection with the first groove 9, and the locating bump 11 matches with and is in clamping connection with the locating hole 14, so that the lower side frame 6 and the first connector 8 are fixedly connected; the circumferential edge of the bottom plate 1 extends downwards to form a clamping ring 15, the bottom of the clamping ring 15 extends outwards and is provided with a hook 16 tilted upwards, the clamping ring 15 matches with and is in inserting connection with the second groove 10, and the hook 16 firstly matches with and is in clamping connection with the limiting groove 12 so that the clamping ring 15 is fixedly connected with the first connector 8, and then the bottom plate 1 is fixedly connected with the first connector 8; the lower side frame 6 is clamped in the first groove 9, and the bottom plate 1 is clamped in the second groove 10, so the bottom plate 1 is fixedly connected with the lower side frame 6; and when the bottom plate 1 is arranged at the bottom of the hollow cylinder body 2, the seat cushion 3 is arranged on the first boss 7 so that the seat cushion 3, the hollow cylinder body 2 and the bottom plate 1 form a storage stool.

Figure 2:
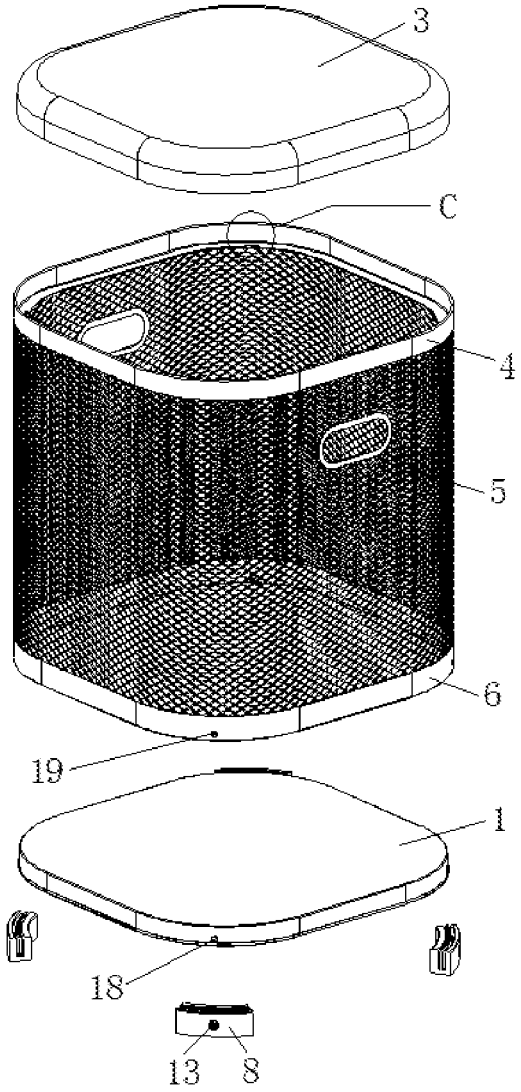
FIG. 2 is a separated structural diagram of the storage table/stool provided by the present disclosure.

Furthermore, the size of the hollow cylinder body 2 can be different, so that a relatively smaller hollow cylinder body 2 can be stacked in a relatively larger hollow cylinder body 2 from the bottom up; therefore, the occupied space during transportation is reduced, the storage table/stool is convenient to transport, and the transportation cost is saved; moreover, the interior of the hollow cylinder body 2 can contain articles so that the practicability of the storage table/stool is largely improved.

Wherein the upper side frame 4, the screen frame body 5 and the lower side frame 6 are formed integrally; the upper side frame 4 and the lower side frame 6 are formed by stretching the screen frame body 5 upwards and downwards.

Wherein as shown in FIG. 2, a through hole 13 is opened in the first connector 8 in a horizontal direction, a thread is arranged in the through hole 13, a first connecting hole 18 is opened in the bottom plate 1 and matches with the through hole 13, and a second connecting hole 19 is opened in the lower side frame 6 and matches with the through hole 13; when the lower side frame 6 and the bottom plate 1 are in inserting connection with the first groove 9 and the second groove 10 of the first connector 8, the fixing screw matches with and locks the first connecting hole 18 and the second connecting hole 19 after passing through the through hole 13, thereby effectively ensuring that the first connector 8 is fixedly connected with the lower side frame 6 and the bottom plate 1 and then ensuring that the bottom plate 1 is fixedly connected with the lower side frame 6.

During assembling, the lower side frame 6 is inserted in the first grooves 9 of the first connectors 8, the locating bumps 11 match with and are inserted in the locating holes 14, the clamping ring 15 of the bottom plate 1 is inserted in the second grooves 10 of the first connectors 8, and the hooks 16 match with and are clamped in the limiting grooves 12, so that the bottom plate 1 is fixedly connected with the lower side frame 6; the seat cushion 3 is placed on the first boss 7 of the upper side frame 4; and at this time the assembling is completed.

Embodiment 3

Figure 5:
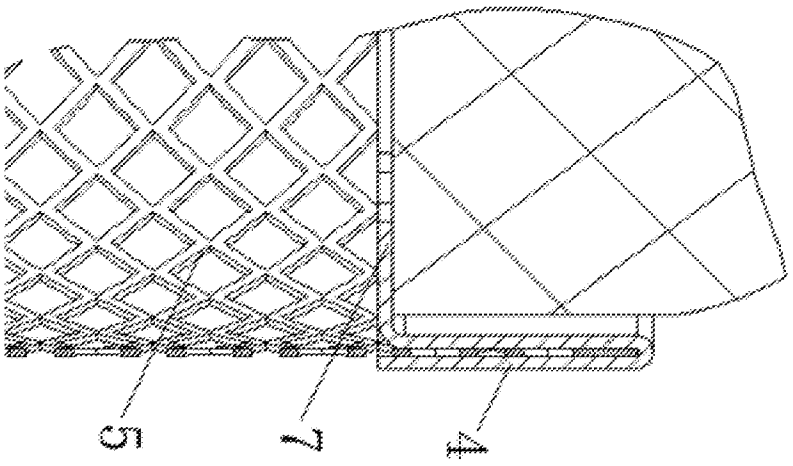
FIG. 5 is a schematic structural diagram of an A-part and an A" part in a storage table/stool provided by embodiment 1 and embodiment 3 of the present disclosure.
Figure 6:
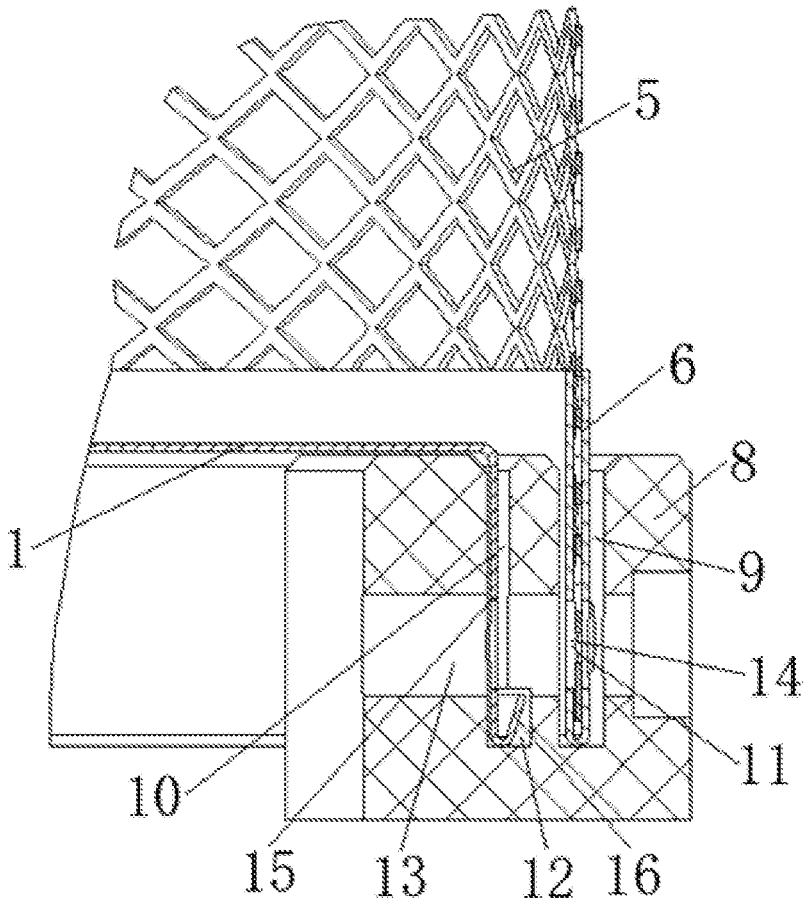
FIG. 6 is a schematic structural diagram of a B-part in the storage table/stool provided by embodiment 1 of the present disclosure.
Figure 10:
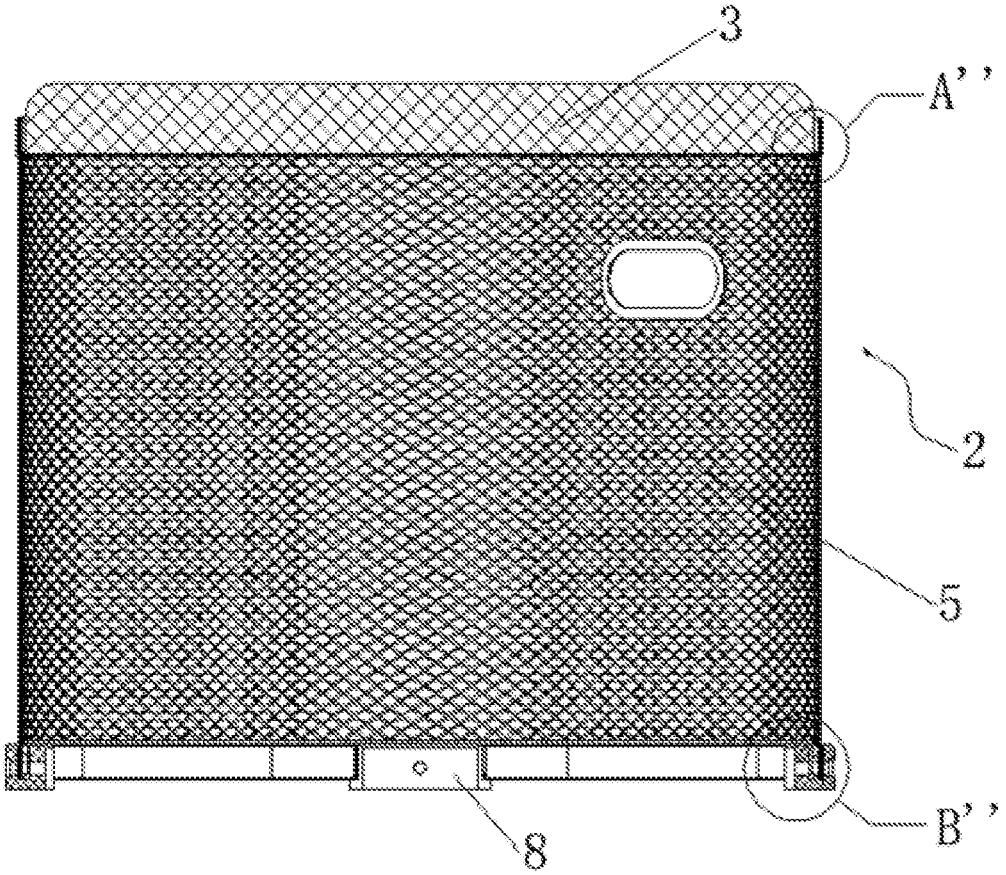
FIG. 10 is a schematic structural diagram of a storage table/stool provided by embodiment 3 of the present disclosure.
Figure 11:
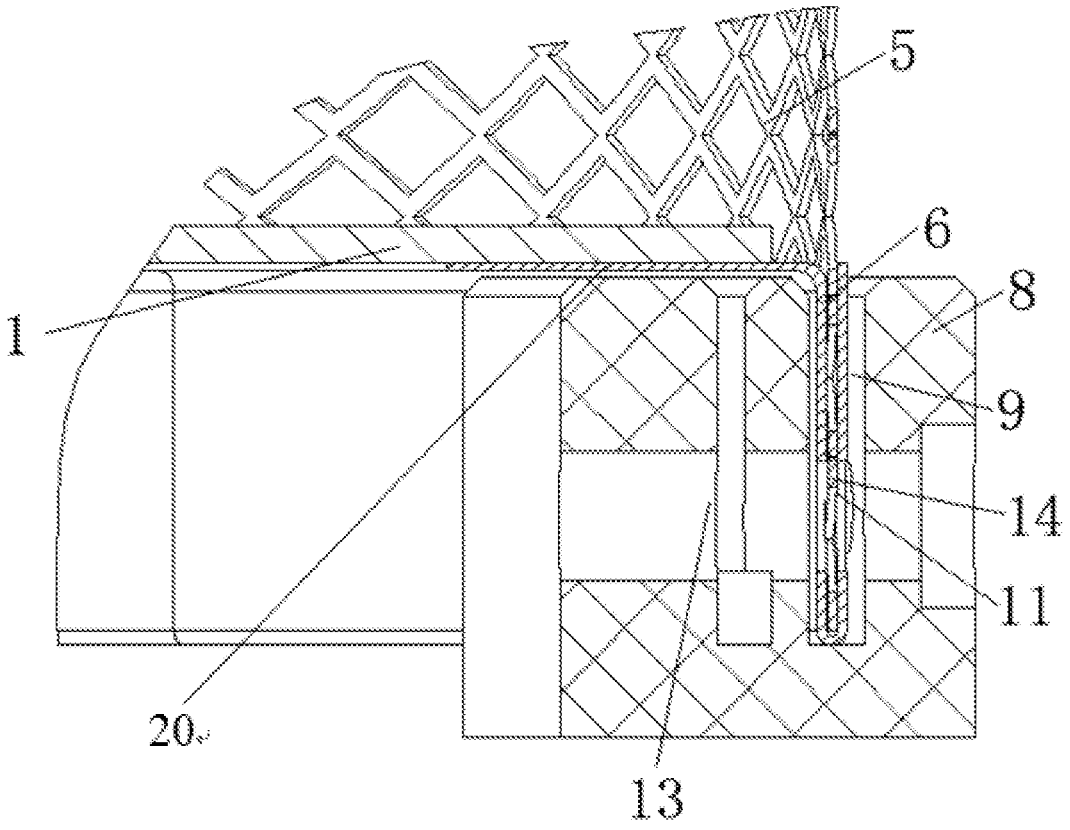
FIG. 11 is a schematic structural diagram of a B"-part in the storage table/stool provided by embodiment 3 of the present disclosure.

Referring to FIG. 5, FIG. 10 and FIG. 11, embodiment 3 of the present disclosure provides a storage table/stool, the storage table/stool comprises a bottom plate 1, a hollow cylinder body 2 and a table plate or a seat cushion 3, wherein the table plate or the seat cushion 3 is placed at the top of the hollow cylinder body 2, the bottom plate 1 is arranged at the bottom of the hollow cylinder body 2, the hollow cylinder body 2 comprises an upper side frame 4, a screen frame body 5 and a lower side frame 6, the upper side frame 4 is arranged at the top of the screen frame body 5, the lower side frame 6 is arranged at the bottom of the screen frame body 5, the upper side frame 4, the screen frame body 5 and the lower side frame 6 are formed separately, the upper side frame 4 is bent inwards to form a first boss 7, the table plate or the seat cushion 3 is detachably placed on the first boss 7, and the bottom plate 1 is arranged at the bottom of the screen frame body 5. The following describes the present embodiment in detail with reference to the accompanying drawings.

As shown in FIG. 10, FIG. 11 and FIG. 14, the lower side frame 6 is bent inwards to form a second boss 20, a plurality of first threaded holes are opened in the second boss 20 and can allow penetration of the fixing screws, a plurality of second threaded holes are opened in the circumferential edge of the bottom plate 1 and match with the first threaded holes, and the fixing screws 22 match with and lock the second threaded holes after passing through the corresponding first threaded holes so that the bottom plate 1 is fixedly connected with the lower side frame 6. When the bottom plate 1 is arranged at the bottom of the hollow screen cylinder body 2, the seat cushion 3 is placed on the first boss 7 so that the seat cushion 3, the hollow cylinder body 2 and the bottom plate 1 form a storage stool; the bottom plate 1 is fixedly arranged on the second boss 20 of the lower side frame 6 through the fixing screws; besides, the lower side frame 6 is inserted in the first grooves 9 of the first connectors 8, and the first connectors 8 are taken as foot pats of the storage stool, thereby preventing the hollow cylinder body 2 from directly coming into contact with the ground and effectively ensuring the service life of the storage stool.

Wherein the upper side frame 4, the screen frame body 5 and the lower side frame 6 are formed separately; the upper side frame 4 sleeves the top of the screen frame body 5, and the upper side frame 4 and the screen frame body 5 are fixedly connected by pressing; and the lower side frame 6 sleeves the bottom of the screen frame body 5, and the lower side frame 6 and the screen frame body 5 are fixedly connected by pressing.

Embodiment 4

Figure 12:
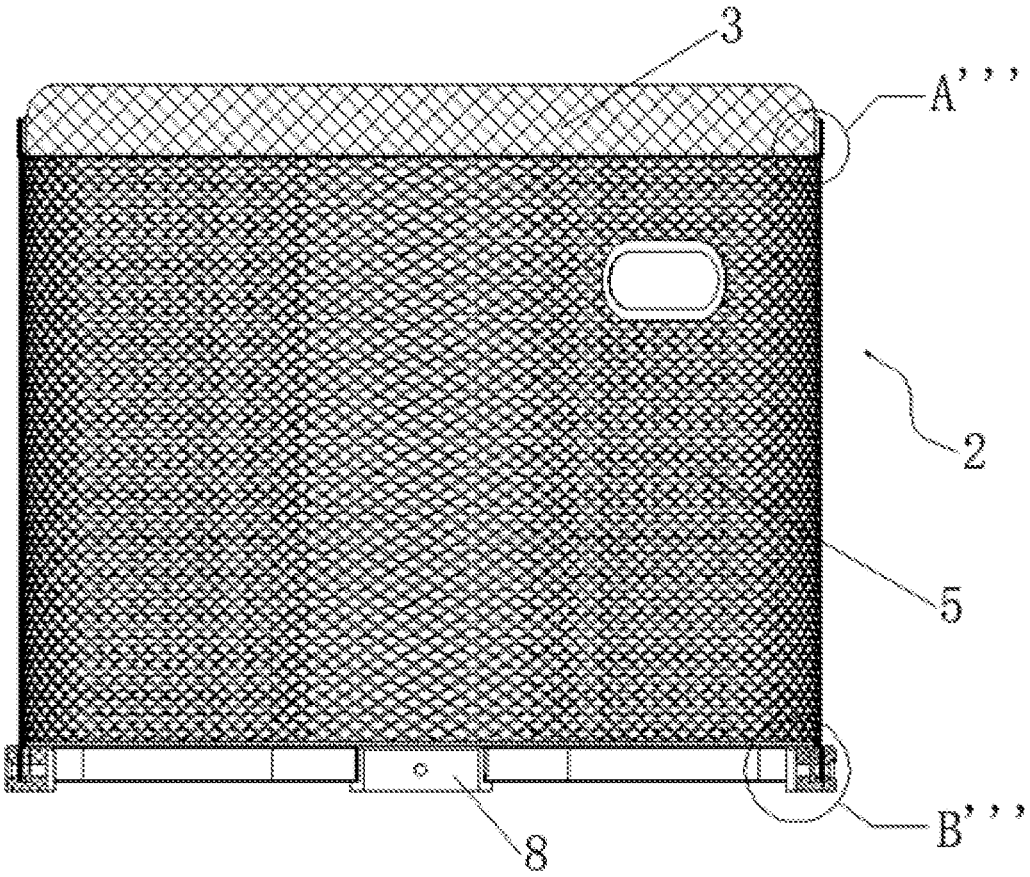
FIG. 12 is a schematic structural diagram of a storage table/stool provided by embodiment 4 of the present disclosure.
Figure 13:
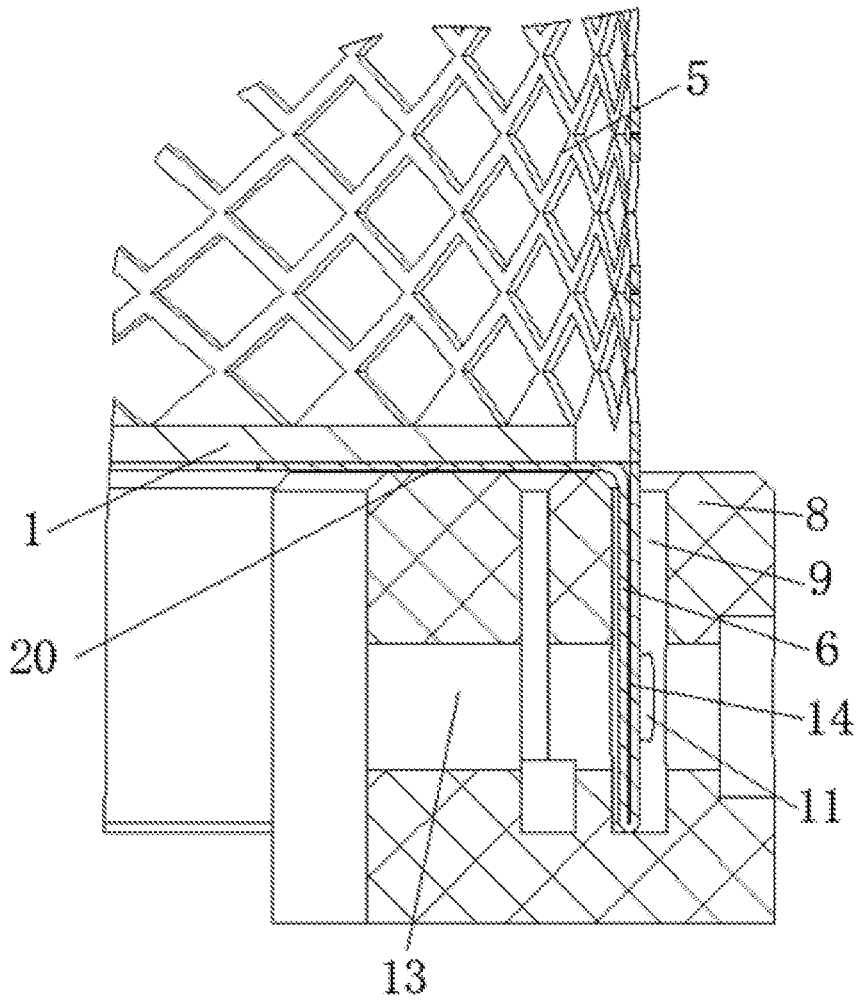
FIG. 13 is a schematic structural diagram of a B'"-part in the storage table/stool provided by embodiment 4 of the present disclosure.

Referring to FIG. 8, FIG. 12 and FIG. 13, embodiment 4 of the present disclosure provides a storage table/stool, the storage table/stool comprises a bottom plate 1, a hollow cylinder body 2 and a table plate or a seat cushion 3, wherein the table plate or the seat cushion 3 is placed at the top of the hollow cylinder body 2, the bottom plate 1 is arranged at the bottom of the hollow cylinder body 2, the hollow cylinder body 2 comprises an upper side frame 4, a screen frame body 5 and a lower side frame 6, the upper side frame 4 is arranged at the top of the screen frame body 5, the lower side frame 6 is arranged at the bottom of the screen frame body 5, the upper side frame 4, the screen frame body 5 and the lower side frame 6 are formed integrally, the upper side frame 4 is bent inwards to form a first boss 7, the table plate or the seat cushion 3 is detachably placed on the first boss 7, and the bottom plate 1 is arranged at the bottom of the screen frame body 5. The following describes the present embodiment in detail with reference to the accompanying drawings.

As shown in FIG. 12, FIG. 13 and FIG. 14, the lower side frame 6 is bent inwards to form a second boss 20, a plurality of first threaded holes are opened in the second boss 20 and can allow penetration of the fixing screws, a plurality of second threaded holes are opened in the circumferential edge of the bottom plate 1 and match with the first threaded holes, and the fixing screws 22 match with and lock the second threaded holes after passing through the corresponding first threaded holes so that the bottom plate 1 is fixedly connected with the lower side frame 6. When the bottom plate 1 is arranged at the bottom of the hollow screen cylinder body 2, the seat cushion 3 is placed on the first boss 7 so that the seat cushion 3, the hollow cylinder body 2 and the bottom plate 1 form a storage stool; the bottom plate 1 is fixedly arranged on the second boss 20 of the lower side frame 6 through the fixing screws; besides, the lower side frame 6 is inserted in the first grooves 9 of the first connectors 8, and the first connectors 8 are taken as foot pats of the storage stool, thereby preventing the hollow cylinder body 2 from directly coming into contact with the ground and effectively ensuring the service life of the storage stool.

Wherein the upper side frame 4, the screen frame body 5 and the lower side frame 6 are formed integrally; the upper side frame 4 and the lower side frame 6 are formed by stretching the screen frame body 5 upwards and downwards.

During assembling, the bottom plate 1 is placed on the second boss 20, and the fixing screws match with and lock the second threaded holes after passing through the first threaded holes so that the bottom plate 1 is fixedly connected with the lower side frame 6; the lower side frame 6 is inserted in the first grooves 9 of the first connectors 8, and the locating bumps 11 match with and are inserted in the locating holes 14 so that the lower side frame 6 is fixedly inserted in the first connectors 8; the seat cushion 3 is placed on the first boss 7 of the upper side frame 4; and at this time, the assembling is completed.

Embodiment 5

Referring to FIG. 15, FIG. 16, FIG. 17 and FIG. 18, embodiment 5 of the present disclosure provides a storage table/stool, the storage table/stool comprises a bottom plate 1, a hollow cylinder body 2 and a table plate or a seat cushion 3, wherein the table plate or the seat cushion 3 is placed at the top of the hollow cylinder body 2, the bottom plate 1 is arranged at the bottom of the hollow cylinder body 2, the hollow cylinder body 2 comprises an upper side frame 4, a screen frame body 5 and a lower side frame 6, the upper side frame 4 is arranged at the top of the screen frame body 5, the lower side frame 6 is arranged at the bottom of the screen frame body 5, the upper side frame 4, the screen frame body 5 and the lower side frame 6 are formed separately, the upper side frame 4 is bent inwards to form a first boss 7, the table plate or the seat cushion 3 is detachably placed on the first boss 7, and the bottom plate 1 is arranged at the interior of the screen frame body 5. The following describes the present embodiment in detail with reference to the accompanying drawings.

Figure 16:
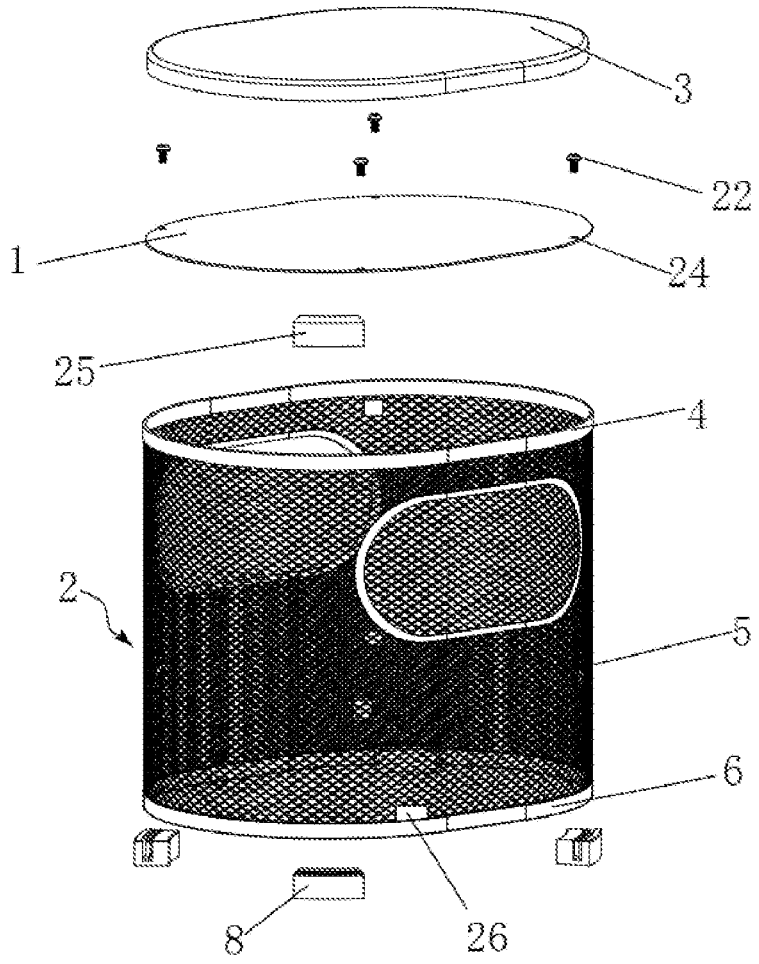
FIG. 16 is a separated schematic structural diagram of the storage table/stool provided by embodiment 5 of the present disclosure.
Figure 17:
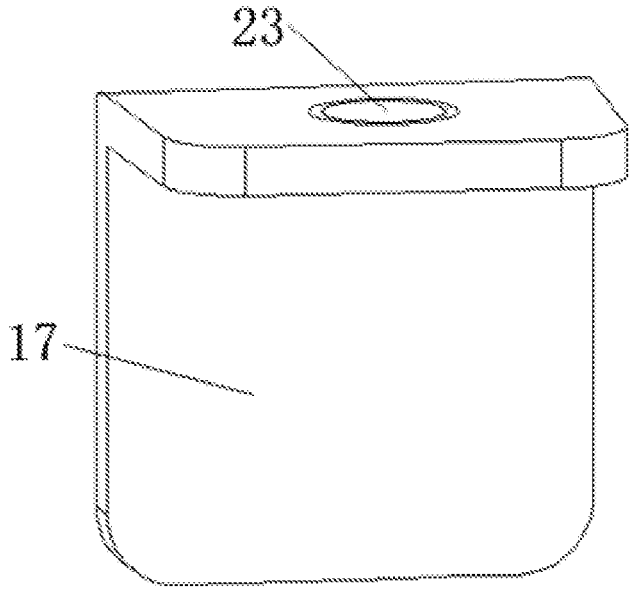
FIG. 17 is a schematic structural diagram of a second connector in the storage table/stool provided by the present disclosure.
Figure 18:
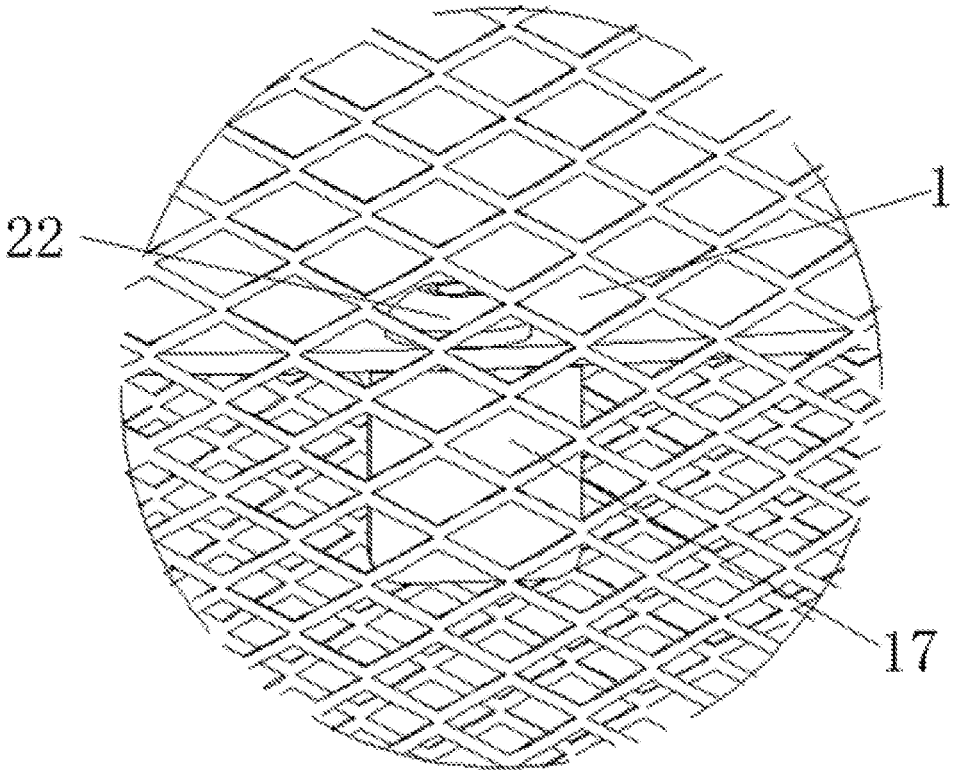
FIG. 18 is a schematic structural diagram of a D-part in the storage table/stool provided by embodiment 5 of the present disclosure.

As shown in FIG. 16, FIG. 17 and FIG. 18, the storage table/stool further comprises second connectors 17 and locking screws 22; each second connector 17 is arranged at the interior of the screen frame body 5; and the second connector 17 is reverse L-shaped, a vertical side of the second connector 17 is welded at the interior of the screen frame body 5, a third threaded hole 23 is opened in a transverse side of the second connector 17, a fourth threaded hole 24 is opened in the bottom plate 1 and matches with the third threaded hole 23, and the locking screw 22 matches with and locks the third threaded hole 23 after passing through the fourth threaded hole 24, so that the bottom plate 1 is fixedly arranged on the transverse side of the second connector 17. When the second connectors 17 are arranged at the interior of the hollow cylinder body 2, and the bottom plate 1 is arranged at the interior of the hollow cylinder body 2, a table plate 3 is placed on the first boss 7, so that the table plate 3, the hollow cylinder body 2 and the bottom plate 1 form a storage table; and the lower side frame 6 is inserted in the first grooves 9 of the first connectors 8, and the first connectors 8 are taken as the foot pats of the storage table, thereby preventing the hollow cylinder body 2 from directly coming into contact with the ground and effectively ensuring the service life of the storage table.

During assembling, the second connectors 17 are welded on the interior of the hollow cylinder body 2, and the fixing screws 22 match with and lock the third threaded holes 23 after passing through the fourth threaded holes 24 so that the bottom plate 1 is fixedly connected with the transverse sides of the second connectors 17; the lower side frame 6 is inserted in the first grooves 9 of the first connectors 8, and the locating bumps 11 match with and are inserted in the locating holes 14 so that the lower side frame 6 is fixedly inserted in the first connectors 8; the table plate 3 is placed on the first boss 7 to form the storage table; and at this time, the assembling is completed.

Wherein the second connectors 17 may also be welded on the inner side face of the upper side frame 4 and the lower side frame 6 so as to form an arrangement table used for arranging the bottom plate 1 and the table plate or the seat cushion 3, which can be selected according to actual situations and is not limited to the present embodiment.

Figure 3:
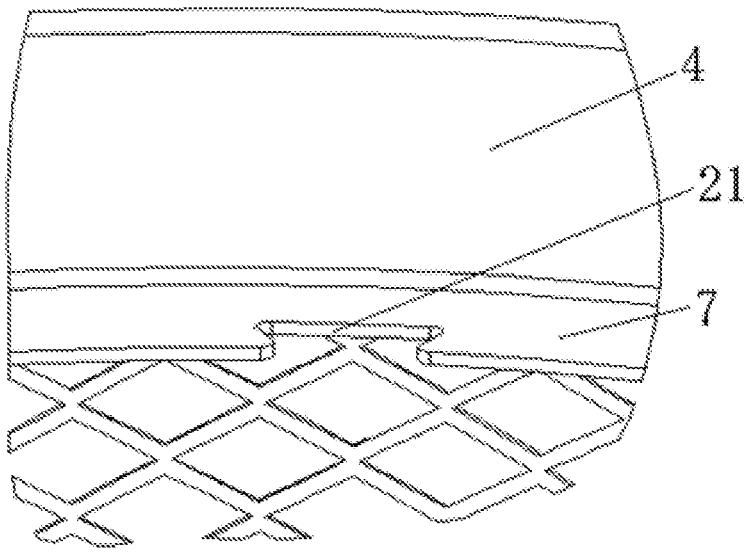
FIG. 3 is a schematic structural diagram of a C-part in the storage table/stool provided by the present disclosure.
Figure 4:
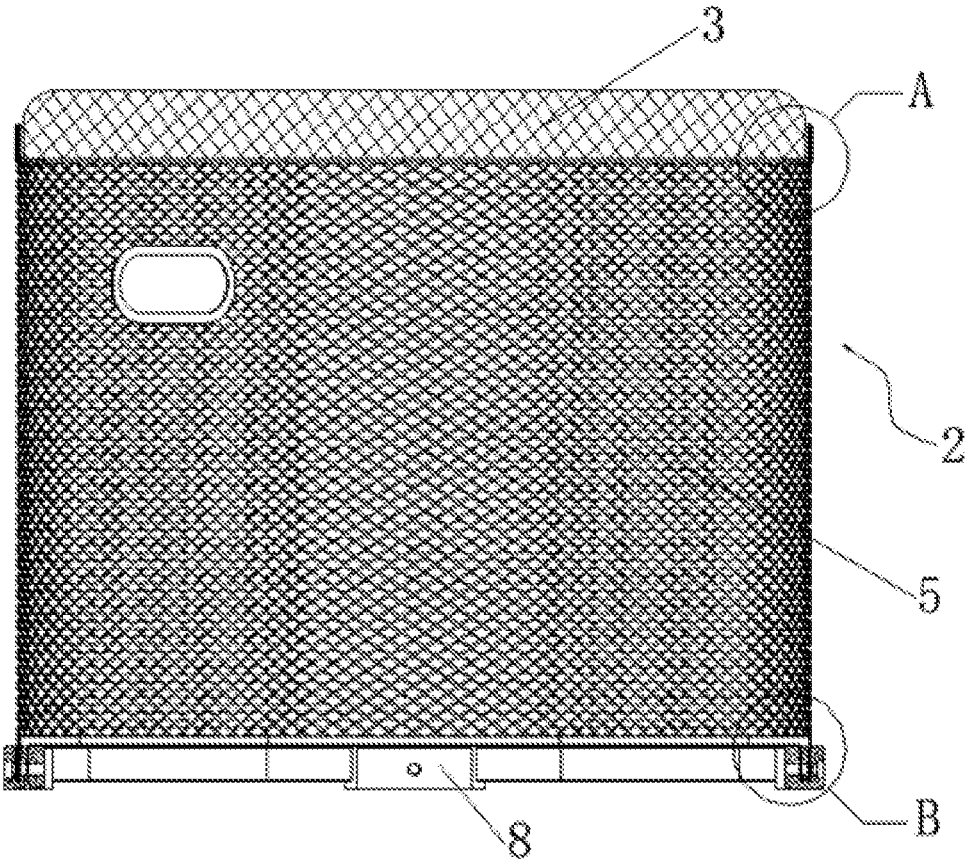
FIG. 4 is a schematic structural diagram of a storage table/stool provided by embodiment 1 of the present disclosure.

Preferably, as shown in FIG. 3, a plurality of grooves 21 are opened in the circumferential edge of the first boss 7; and due to the arrangement of the grooves 21, the first boss 7 is easy to be bent inwards, so that the hollow cylinder body 2 can form various shapes and the bottom plate 1 is easy to be placed in the bottom or the bottom of the hollow cylinder body 2 from the top down.

Wherein the screen frame body 5 is a metal screen frame body, and certainly can also be screen frame bodies 5 fabricated by other materials, which can be selected according to actual situations and is not limited to the present embodiment.

Wherein the hollow cylinder body 2 is a hollow column body with a section in shape of an ellipse, a square, a circle or a polygonal rhombus, which can be selected according to actual situations and is not limited to the present embodiment.

Preferably, the bottom plate 1 can be an iron bottom plate, a glass bottom plate, a wood bottom plate or a leather bottom plate, and certainly can also be bottom plates 1 fabricated by other materials, which can be selected according to actual situations and is not limited to the present embodiment.

Preferably, the table plate 3 can be an iron table plate, a glass table plate, a wood table plate or a leather table plate, and certainly can also be table plates 3 fabricated by other materials, which can be selected according to actual situations and is not limited to the present embodiment.

Preferably, a bluetooth 25 is arranged at the bottom of the bottom plate 1, and the bluetooth 25 is connected with a bluetooth button 26 arranged at the lower part of the screen frame body 5, so the storage table/stool further has a music playing function.

Embodiment 6

Figure 19:
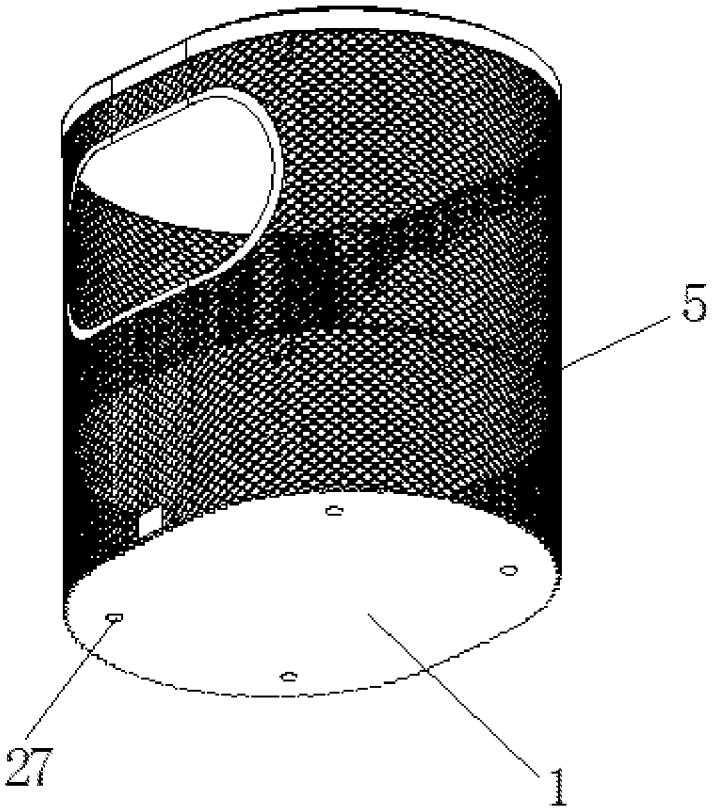
FIG. 19 is a stereo schematic structural diagram of the storage table/stool provided by embodiment 6 of the present disclosure.

Referring to FIG. 19, embodiment 6 of the present disclosure provides a storage table/stool. In the present embodiment, the bottom plate 1 and the lower side frame 6 are welded integrally, and the bottom of the bottom plate 1 is provided with grounded bumps 27.

To sum up, the storage table/stool of the present disclosure has a simple structure and comprises the bottom plate 1, the hollow cylinder body 2 and the table plate or the seat cushion 3, the table plate or the seat cushion 3 is placed at the top of the hollow cylinder body 2, and the bottom plate 1 is arranged at the interior or the bottom of the hollow cylinder body 2, wherein the hollow cylinder body 2 comprises the upper side frame 4, the screen frame body 5 and the lower side frame 6, the upper side frame 4 is arranged at the top of the screen frame body 5, the lower side frame 6 is arranged at the bottom of the screen frame body 5, the upper side frame 4, the screen frame body 5 and the lower side frame 6 are formed separately or integrally, the upper side frame 4 is bent inwards to form a first boss 7, the table plate or the seat cushion 3 is detachably placed on the first boss 7, and the bottom plate 1 is arranged at the interior or the bottom of the screen frame body 5. The storage table/stool is convenient to assemble; different sizes of a plurality of storage tables/stools can be stacked during transportation so that the occupied space during transportation is reduced, the storage tables/stools are convenient to transport, and the transportation cost is saved; and the interior of the hollow cylinder body 2 can contain articles so that the practicability of the storage table/stool is largely improved.

The above embodiments are preferable embodiments of the present disclosure. However, the embodiments of the present disclosure are not limited to the above embodiments. Any other variations, modifications, substitutions, combinations, simplifications or the like equivalent replacements made to the present disclosure without departing from the spiritual essence and principle of the present disclosure shall all be covered within the protection scope of the present disclosure.

What is claimed is:

1. A storage table/stool, characterized by comprising: a bottom plate (1), a hollow cylinder body (2) and a table plate or a seat cushion (3), wherein the table plate or the seat cushion (3) is placed at a top of the hollow cylinder body (2), the bottom plate (1) is arranged at an interior or a bottom of the hollow cylinder body (2), the hollow cylinder body (2) comprises an upper side frame (4), a screen frame body (5) and a lower side frame (6), the upper side frame (4) is arranged at a top of the screen frame body (5), the lower side frame (6) is arranged at a bottom of the screen frame body (5), the upper side frame (4), the screen frame body (5) and the lower side frame (6) are formed separately or integrally, the upper side frame (4) is bent inwards to form a first boss (7), the table plate or the seat cushion (3) is detachably placed on the first boss (7), and the bottom plate (1) is arranged at an interior or a bottom of the screen frame body (5);

the storage table/stool further comprises first connectors (8), wherein the first connectors (8) match with and are fixedly connected with the lower side frame (6) and the bottom plate (1); each first connector (8) is provided with a first groove (9) and a second groove (10), a locating bump (11) is arranged on one side face of the first groove (9), a limiting groove (12) is opened in a bottom of one side of the second groove (10), a locating hole (14) is opened in the lower side frame (6), and matches with and is in clamping connection with the locating bump (11), the lower side frame (6) matches with and is in inserting connection with the first groove (9), and the locating bump (11) matches with and is in clamping connection with the locating hole (14), so that the lower side frame (6) and the first connector (8) are fixedly connected; and a circumferential edge of the bottom plate (1) extends downwards to form a clamping ring (15), a bottom of the clamping ring (15) extends outwards and is provided with a hook (16) tilted upwards, the clamping ring (15) matches with and is in inserting connection with the second groove (10), and the hook (16) firstly matches with and is in clamping connection with the limiting groove (12) so that the clamping ring (15) is fixedly connected with the first connector (8), and then the bottom plate (1) is fixedly connected with the first connector (8).

2. The storage table/stool according to claim 1, characterized in that a through hole (13) is opened in the first connector (8) in a horizontal direction, a thread is arranged in the through hole (13), a first connecting hole (18) is opened in the bottom plate (1) and matches with the through hole (13), and a second connecting hole (19) is opened in the lower side frame (6) and matches with the through hole (13).

3. The storage table/stool according to claim 1, characterized by further comprising second connectors (17) and locking screws (22), wherein each second connector (17) is arranged at the interior of the screen frame body (5); and the second connector (17) is reverse L-shaped, a vertical side of the second connector (17) is welded at the interior of the screen frame body (5), a third threaded hole (23) is opened in a transverse side of the second connector (17), a fourth threaded hole (24) is opened in the bottom plate (1) and matches with the third threaded hole (23), and the locking screw (22) matches with and locks the third threaded hole (23) after passing through the fourth threaded hole (24), so that the bottom plate (1) is fixedly arranged on the transverse side of the second connector (17).

4. The storage table/stool according to claim 3, characterized in that a wireless communication device (25) is arranged at a bottom of the bottom plate (1), and the wireless communication device (25) is connected with a wireless communication button (26) arranged at a lower part of the screen frame body (5).

5. The storage table/stool according to claim 1, characterized by further comprising fixing screws, wherein the lower side frame (6) is bent inwards to form a second boss (20), a plurality of first threaded holes are opened in the second boss (20) and can allow penetration of the fixing screws, a plurality of second threaded holes are opened in a circumferential edge of the bottom plate (1) and match with the first threaded holes, and the fixing screws match with and lock the second threaded holes after passing through the corresponding first threaded holes so that the bottom plate (1) is fixedly connected with the lower side frame (6).

6. The storage table/stool according to claim 1, characterized in that a plurality of grooves (21) are opened in a circumferential edge of the first boss (7).

7. The storage table/stool according to claim 1, characterized in that the screen frame body (5) is a metal screen frame body.

8. The storage table/stool according to claim 1, characterized in that the hollow cylinder body (2) is a hollow column body with a section in shape of an ellipse, a square, a circle or a polygonal rhombus.

9. The storage table/stool according to claim 1, characterized in that the bottom plate (1) and the lower side frame (6) are welded integrally, and a bottom of the bottom plate (1) is provided with bumps (27) configured to be in contact with a support surface.

* * * * *